US007654000B2

(12) United States Patent
Prociw et al.

(10) Patent No.: US 7,654,000 B2
(45) Date of Patent: Feb. 2, 2010

(54) MODULAR FUEL NOZZLE AND METHOD OF MAKING

(75) Inventors: Lev Alexander Prociw, Elmira (CA); Joseph Horace Brand, Mississauga (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 222 days.

(21) Appl. No.: 11/751,818

(22) Filed: May 22, 2007

(65) Prior Publication Data

US 2007/0234569 A1 Oct. 11, 2007

Related U.S. Application Data

(62) Division of application No. 11/081,531, filed on Mar. 17, 2005, now Pat. No. 7,237,730.

(51) Int. Cl.
*B21K 21/08* (2006.01)
*B22F 7/00* (2006.01)

(52) U.S. Cl. ..... 29/890.142; 419/6; 239/406; 60/748

(58) Field of Classification Search ..... 29/890.142, 29/890.127, 890.143, 890.124; 239/403, 239/405, 406, 423, 424; 60/740, 742, 746, 60/747, 748; 419/5, 6, 7, 36
See application file for complete search history.

(56) References Cited

U.S. PATENT DOCUMENTS

| | | | | |
|---|---|---|---|---|
| 2,669,090 | A | 2/1954 | Jackson | |
| 3,169,367 | A | 2/1965 | Hussey | |
| 3,608,309 | A | 9/1971 | Hill et al. | |
| 4,226,088 | A | 10/1980 | Tsukahara et al. | |
| 4,246,757 | A | 1/1981 | Heberling | |
| 4,475,344 | A | 10/1984 | Mumford et al. | |
| 4,590,769 | A | 5/1986 | Lohmann et al. | |
| 4,702,073 | A | 10/1987 | Melconian | |
| 4,708,741 | A * | 11/1987 | Amaya | 75/255 |
| 4,881,431 | A * | 11/1989 | Bieneck | 76/108.6 |
| 5,115,634 | A | 5/1992 | Bretz et al. | |
| 5,129,231 | A | 7/1992 | Becker et al. | |
| 5,165,226 | A | 11/1992 | Newton et al. | |
| 5,307,637 | A | 5/1994 | Stickles et al. | |
| 5,398,509 | A | 3/1995 | North et al. | |
| 5,554,338 | A * | 9/1996 | Sugihara et al. | 419/5 |
| 5,590,531 | A | 1/1997 | Desaulty et al. | |
| 5,616,026 | A * | 4/1997 | Cash | 433/8 |
| 5,722,032 | A * | 2/1998 | Gay | 419/6 |
| 5,956,955 | A | 9/1999 | Schmid | |
| 6,033,788 | A * | 3/2000 | Cawley et al. | 428/548 |
| 6,073,518 | A * | 6/2000 | Chow et al. | 76/108.2 |
| 6,082,113 | A | 7/2000 | Prociw et al. | |
| 6,203,752 | B1 * | 3/2001 | Bewlay et al. | 419/6 |
| 6,322,746 | B1 * | 11/2001 | LaSalle et al. | 419/6 |

(Continued)

OTHER PUBLICATIONS

U.S. Appl. No. 11/551,021, Oct. 19, 2006, Stastny et al.

(Continued)

*Primary Examiner*—David P Bryant
*Assistant Examiner*—Ryan J Walters
(74) *Attorney, Agent, or Firm*—Ogilvy Renault

(57) ABSTRACT

A modular fuel nozzle configuration is defined which permits lower-cost manufacturing operations such as injection moulding to be employed. Also described is a method of making such a component.

4 Claims, 8 Drawing Sheets

U.S. PATENT DOCUMENTS

| | | | | |
|---|---|---|---|---|
| 6,427,446 | B1 | 8/2002 | Kraft et al. | |
| 6,660,225 | B2 * | 12/2003 | Lim et al. | 419/6 |
| 6,730,263 | B2 * | 5/2004 | Ernst et al. | 419/6 |
| 6,883,332 | B2 * | 4/2005 | Steinthorsson et al. | 60/776 |
| 7,052,241 | B2 * | 5/2006 | Decker | 416/213 R |
| 7,543,383 | B2 * | 6/2009 | Patel et al. | 29/890.142 |
| 2002/0008166 | A1 * | 1/2002 | Fukaya et al. | 239/533.12 |
| 2003/0213249 | A1 | 11/2003 | Pacheco-Tougas et al. | |
| 2005/0036898 | A1 | 2/2005 | Sweetland | |
| 2006/0049282 | A1 * | 3/2006 | Bowman et al. | 239/494 |
| 2007/0017817 | A1 | 1/2007 | Mueller et al. | |
| 2007/0020135 | A1 | 1/2007 | Jackson et al. | |
| 2007/0102572 | A1 | 5/2007 | Bohdal | |
| 2007/0104585 | A1 | 5/2007 | Ochiai et al. | |
| 2007/0137208 | A1 * | 6/2007 | Prociw et al. | 60/748 |

OTHER PUBLICATIONS

Powder Metallurgy 2007 Facts- "A Growth Industry Vital to Many Products"; Metal Powder Industries Federation.

Power Injection Moulding International (PIM International) "Flexibility Helps MIM Producer Meet the Demands of a Broad Client Base".

"An Introduction to Powder Metallurgy Materials and Design", Isabel J van Rooyen, Metals and Metals Processes, CSIR, Private bag X28, Auckland Park, 2006, South Africa.

NMC: "Enhanced Powder Metallurgy Processing of Superalloys for Aircraft Engine Components".

NATO:"Powder Injection Molding (PIM) for Low Cost Manufacturing of Intricate Parts to Net-Shape", Eric Baril et al., pp. 7-1 to 7-12.

NATO: "Metal Injection Moulding: A Near Net Shape Fabrication Method for the Manufacture of Turbine Engine Component", Benoit Julien et al., pp. 8-1 to 8-16.

* cited by examiner

MODULAR FUEL NOZZLE AND METHOD OF MAKING

REFERENCE TO CROSS-RELATED APPLICATIONS

This is a Divisional Application of U.S. patent application Ser. No. 11/081,531 filed on Mar. 17, 2005 now U.S. Pat. No. 7,237,730.

TECHNICAL FIELD

The technical field of the invention relates to fuel nozzles such as those for use in gas turbine engines, and in particular fuel nozzles which employ pressurized air.

BACKGROUND OF THE ART

Fuel nozzles vary greatly in design. One approach, shown in U.S. Pat. No. 5,115,634, involves the use of swirler airfoils or vanes arrayed around a central fuel orifice. Nozzles of this type can be costly to manufacture. Another approach, shown in the Applicant's U.S. Pat. No. 6,082,113 provides a plurality or air channels drilled around a central fuel orifice in a solid nozzle tip, which provides good mixing and is relatively cheaper to manufacture. However, the machining, drilling and finishing operations still require some time and precision to complete, and hence opportunities for cost-reduction yet exist.

SUMMARY OF THE INVENTION

In one aspect, the present invention provides a fuel nozzle for a gas turbine engine, the nozzle comprising a body defining at least a central fuel passage therethrough, the fuel passage exiting the body through a spray orifice, the body having a conical peripheral surface with the spray orifice disposed at an apex of the conical peripheral surface, the conical peripheral surface including a plurality of open-section channels defined therein, the channels radiating along the conical peripheral surface around the spray orifice; and an annular collar mounted to the body, the collar and conical surface of the body co-operating to define a plurality of enclosed air passages corresponding to the channels.

In a second aspect, the present invention provides a fuel nozzle for a gas turbine engine, the nozzle comprising: a body defining at least one fuel passage centrally therethrough, the fuel passage exiting the body through a spray orifice, the body having a conical peripheral surface with the spray orifice disposed at an apex of the conical peripheral surface, an annular collar mounted to the body around the conical surface, the collar and conical surface of the body co-operating to define a plurality of air passages therebetween, the air passages arranged in an array radiating around the spray orifice; wherein at least one of the body and the annular collar have a plurality of open-section channels defined therein, the channels partially defining the air passages.

In a third aspect, the present invention provides a method of making a fuel nozzle comprising the steps of injection moulding a nozzle body in a first mould; exposing at least a portion of the body from the first mould; impressing a second mould against at least a portion of the exposed portion of the body; and then sintering the body.

In a fourth aspect, the present invention provides an apparatus and method as described herein.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
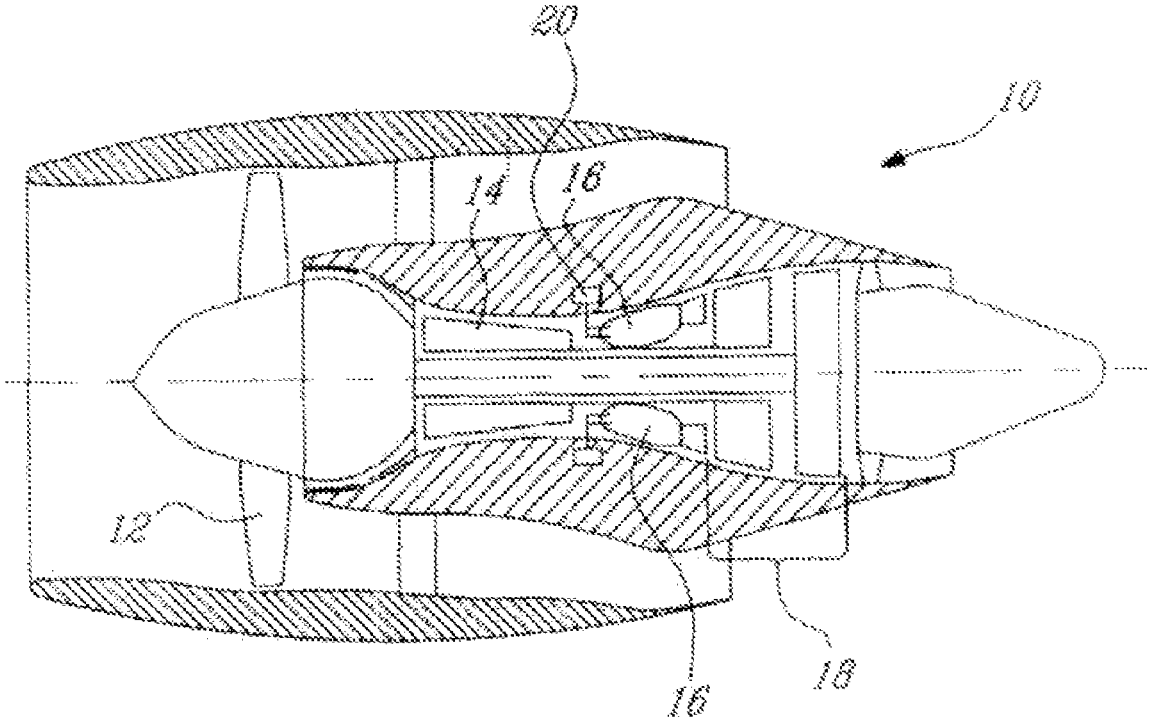
FIG. 1 shows a gas turbine engine including the invention.
Figure 2:
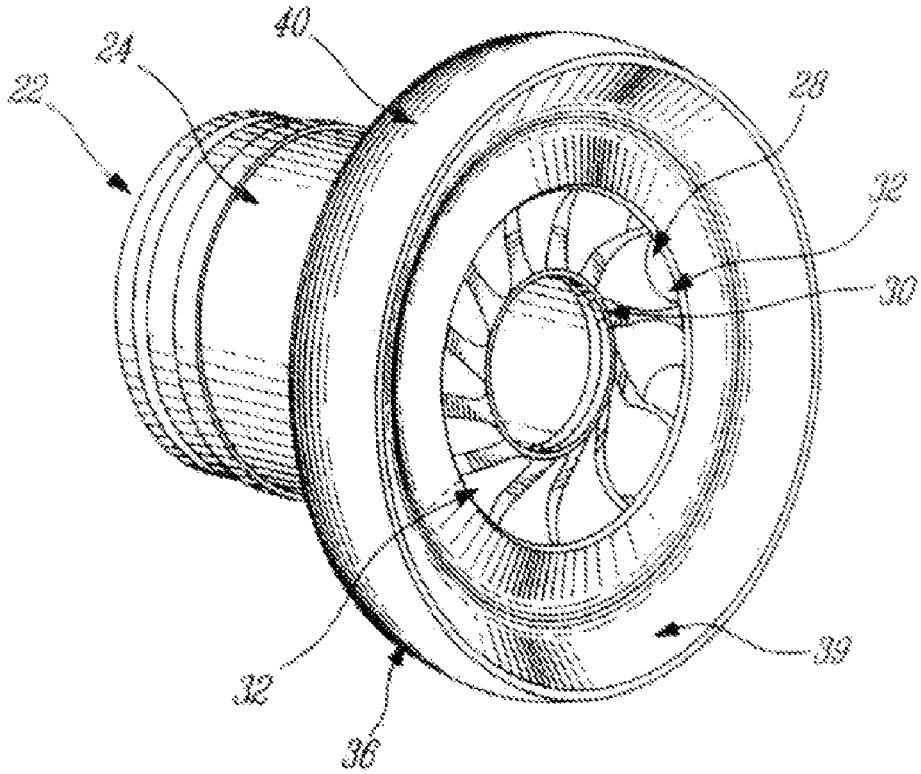
FIG. 2 is an isometric view of a fuel nozzle according to one embodiment of the present invention.
Figure 3:
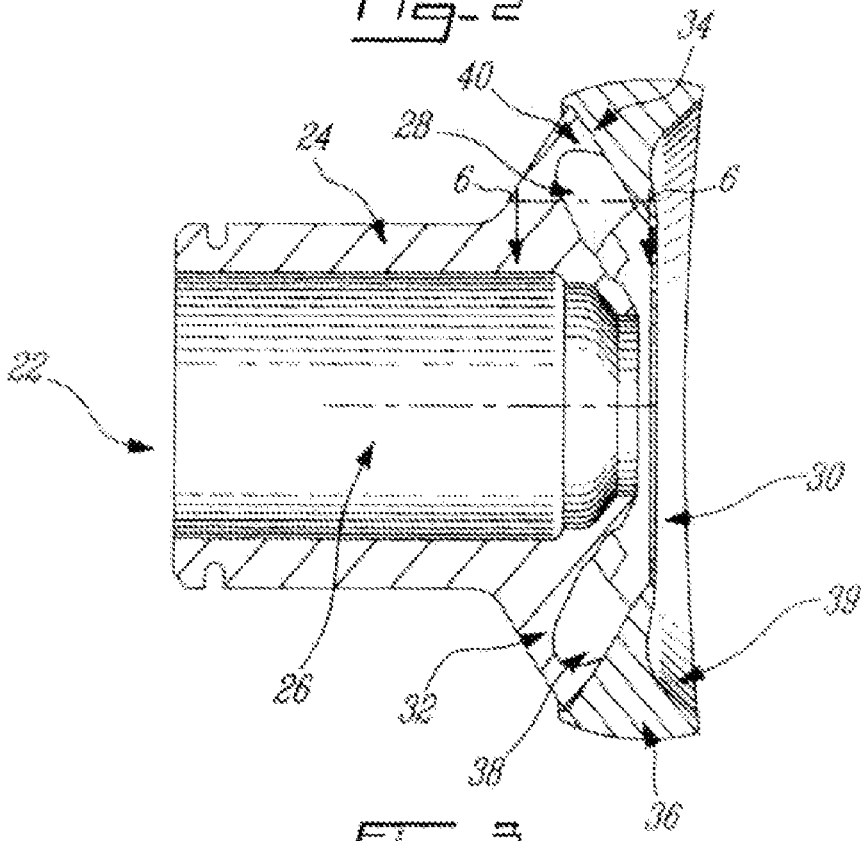
FIG. 3 is a cross-sectional view of the fuel nozzle of FIG. 2.
Figure 4A:
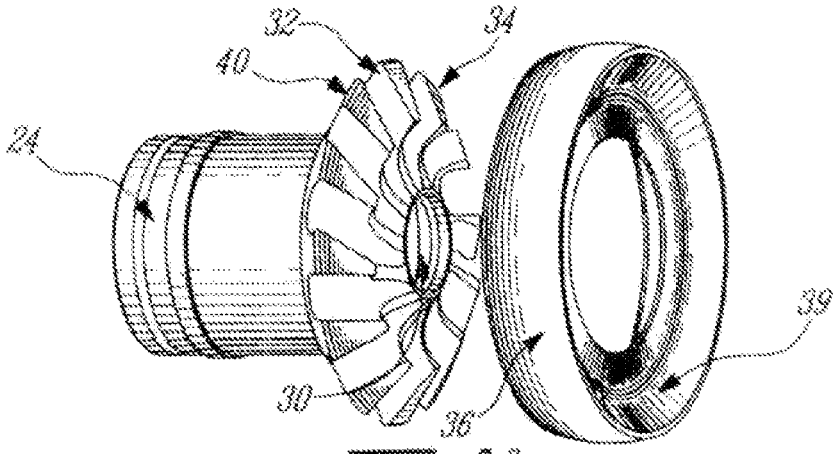
FIGS. 4*a* and 4*b* are respectively an exploded isometric view and a front view of the fuel nozzle of FIG. 2, the front annular collar of the nozzle being omitted in FIG. 4*b* to reveal the channels in the fuel nozzle body.
Figure 4B:
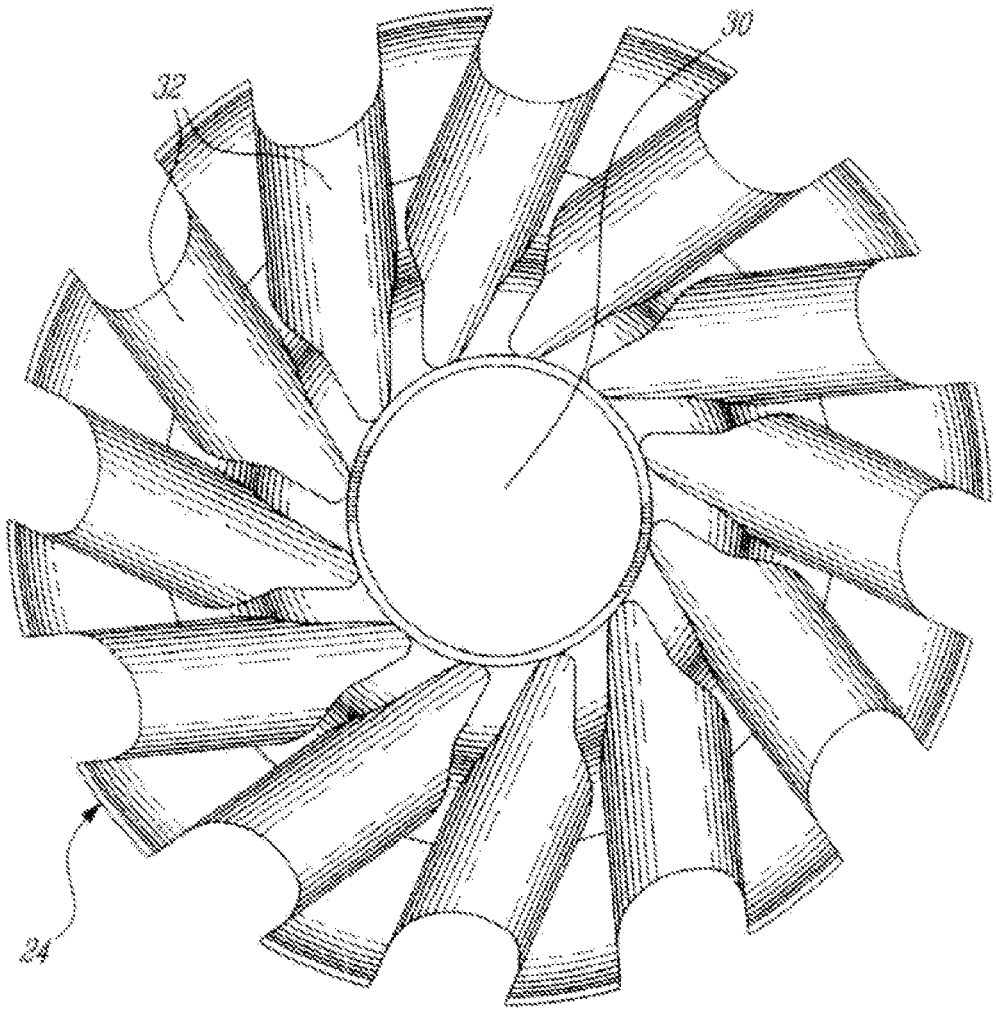
Figure 5:
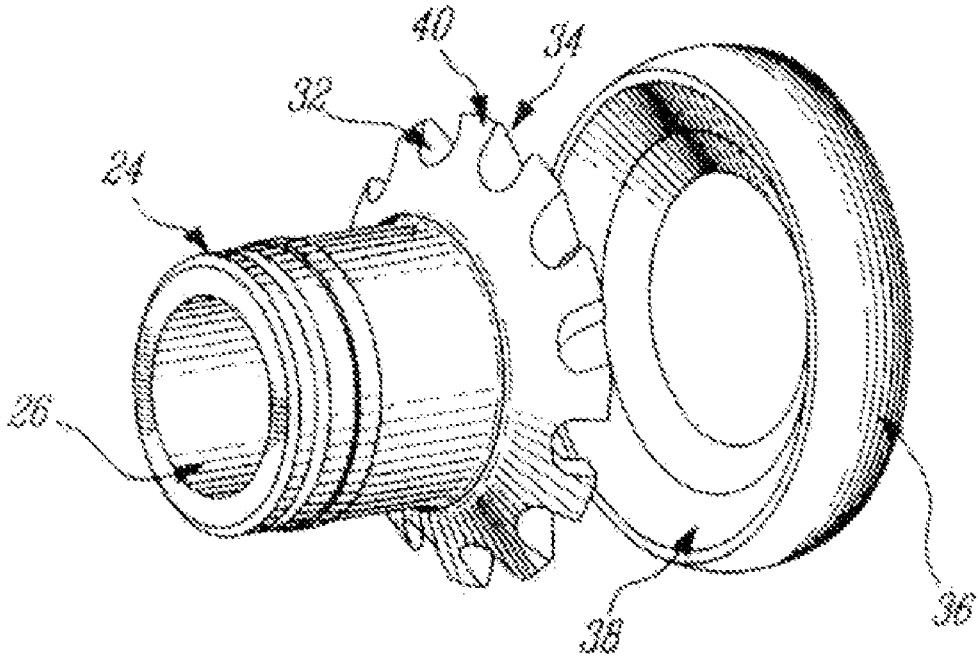
FIG. 5 is rear view of FIG. 4*a;*

Referring to FIG. 1, a turbofan gas turbine engine 10 has in serial flow communication a fan 12 through which ambient air is propelled, a compressor 14 for further pressurizing a portion of the air, a combustor 16 in which the compressed air is mixed with fuel and ignited, and a turbine section 18 for extracting rotational energy from the combustion gases. The combustor 16 includes a plurality of fuel nozzles 20 according to the present invention, as will be described in more detail.

Referring now to FIGS. 2-5, nozzle 20 includes a nozzled tip 22 which is in this embodiment an air-blast type, meaning that the tip 22 has a body 24, commonly known as a fuel distributor, which has at least a fuel passage 26 defined therethrough, preferably with a fuel swirler 27 therein (not shown, but see FIG. 12), and an array of air passages 28 encircling an spray orifice exit 30 of the fuel passage 26. The fuel swirler 27 may be provided in accordance with the applicant's co-pending application Ser. No. 10/743,712, filed Dec. 24, 2003. The air passages are comprised of open-section channels 32 defined in a conical peripheral surface 34 of the body 24, the spray orifice 30 being located at the apex (not indicated) of the conical peripheral surface 34. (the skilled reader will appreciate that the term "conical" is used loosely to also encompass frustoconical surfaces, and other similarly angled surfaces) The channels 32 radiate away from the spray orifice along the conical peripheral surface 34. The open-section channels 32 are closed in this embodiment by an annular collar or cap 36 mounted around the body 24, the cap 36 having a smooth inner conical surface 38 co-operating with channels 32 and conical peripheral surface 34 to thereby provide closed-sectioned channels 32. This provides a configuration which may be conveniently provided using relatively inexpensive manufacturing techniques such as grinding or injection moulding, rather than drilling, as will be described further below. The cap 36 also has an aerodynamic outer surface 39, designed to optimise nozzle spray pattern and mixing characteristics. Surface 39, and in fact many other features of tip 22 may be provided generally in accordance with the teaching of the Applicant's U.S. Pat. No. 6,082,113, incorporated herein by reference, as will be appreciated by the skilled reader. It will be appreciated that air passages 28 and channels 32 provide aerodynamic surfaces for the delivery of air and fuel-air mixtures, and thus are subject to aerodynamic design constraints. Thus, the manner is which such features may be successfully manufactured is affected.

The channels 32, with their side-by-side arrangement, result in web portions 40 therebetween. Web portions 40 preferably intimately contact inner surface 38, for reasons to be described below. The skilled reader will appreciate that surfaces such as those of channel 32 are aerodynamically designed to promote mixing, swirl, efficient air and fluid flow, etc.

Figure 6:
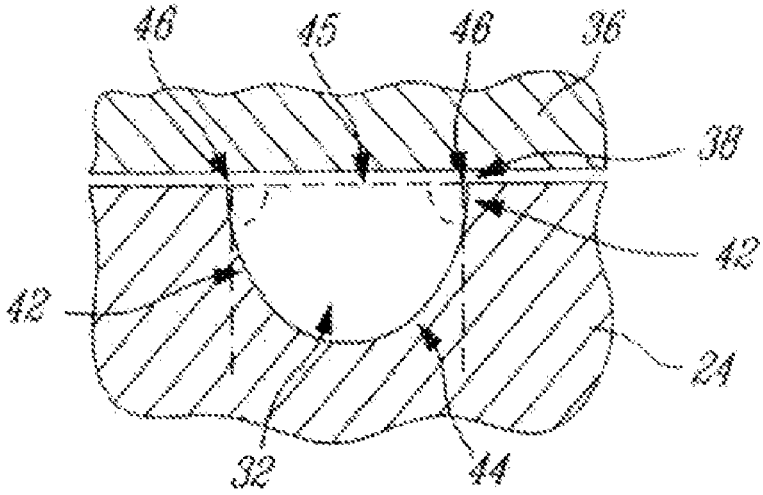
FIG. 6 is a cross-sectional view of the nozzle of FIG. 3, taken along the lines 6-6.

Referring to FIG. 6, channel 32, when viewed in lateral cross-section, has side walls 42 and bottom wall 44. In the embodiment depicted, sidewalls 42 and bottom wall 44 have the same general radius of curvature, and thus the transition between them is indistinct. Side and bottom walls 42, 44 may however, have any radius (including infinite radius, or in other words, be generally planar) and may have any combination of positions having differing radii of planar portions—i.e. the shape of side and bottom walls 42, 44 is almost limitless. In order to facilitate simple manufacturing of channels 32, however, as mentioned above channel 32 has an "open-section", meaning that side walls 42 are either parallel to one another or converge towards one another, relative to the viewpoint shown in FIG. 6. As indicated by the dotted lines in FIG. 6, this means that the angle between walls 42 at any location and an imaginary line 46 joining opposed intersection points 46 is 90° or less (the skilled reader will appreciate that the "point" 46 is in fact a line out of the plane of the page of FIG. 6). The sidewall 42 and bottom wall 44 thus subtend an angle of 180° or less, as measured from a midpoint of the above-mentioned imaginary line 45. This configuration permits a tool, such as a milling or grinding tool, or a moulding tool, to be inserted and withdrawn generally normally (perpendicularly) from the channel—that is, such a tool may be used to form the channel 32, and then subsequently normally (perpendicularly) withdrawn form the channel, thus greatly simplifying the motions and tools required in manufacture of the nozzle tip 22. This can also be readily appreciated from FIGS. 4*a*, 4*b* and 11. Drilling or a complex mould(s) is not required, which can decrease cost of manufacture and permit improved manufacturing tolerances.

Figure 7:
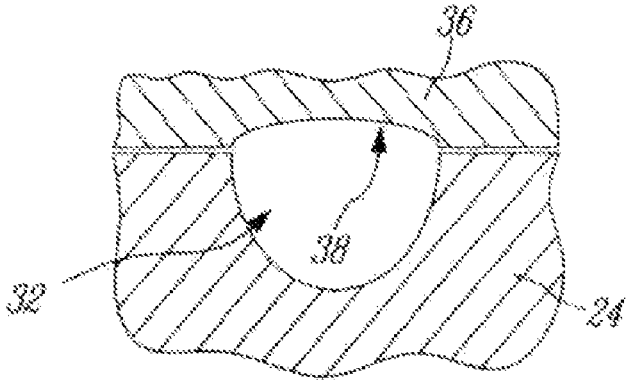
FIG. 7 is a view similar to FIG. 6, showing an alternate embodiment of the present invention.
Figure 8:
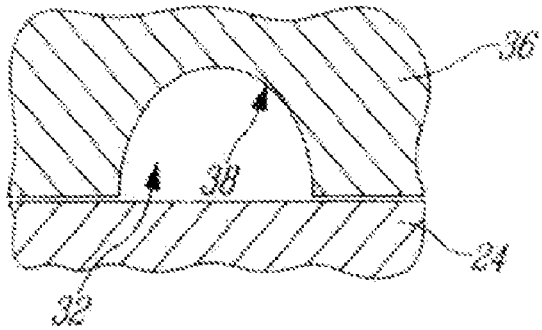
FIG. 8 is a view similar to FIG. 6, showing another embodiment of the present invention.
Figure 9:
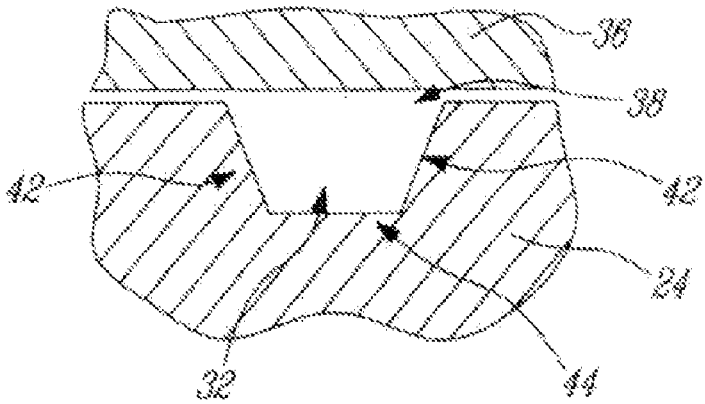
FIG. 9 is a view similar to FIG. 6, showing another embodiment of the present invention.

As represented briefly in FIGS. 7-9, and as will be understood by the skilled reader in light of the present disclosure, passage 28 is defined through the co-operation of two or more surfaces, in this case two surfaces are provided by nozzle body 24 and cap 36. Thus the channel 32 may in fact be a pair of channels, one defined in each of nozzle body 24 and cap 36 (FIG. 7) for example, or may be entirely defined in cap 36 (FIG. 8), and/or maybe non-circular (FIG. 9). A variety of configurations is thus available. Not all passages 28 need be identical, either. Other elements besides body 24 and cap 36 may be employed, as well, as described below.

The geometry of the channels allows simpler manufacturing. For example, a grinding tool may be used to grind the channel by inserting the tool (i.e. as grinding progresses) in a purely axial direction (i.e. vertically down the page in the FIG. 6 or perpendicular to the page in FIG. 4*b*) and then extracted in the reverse direction without damaging the channel. Simplified machining operations results in part cost savings, and typically improved tolerances.

Perhaps more advantageously, however, the described configuration permits injection moulding operations to be used, as will now be described in more detail.

Figure 10:
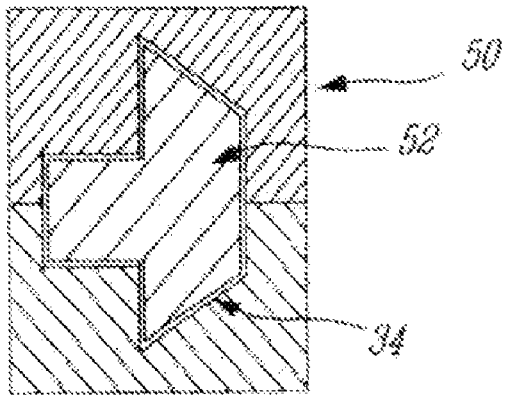
FIGS. 10-12 schematically depict a method of manufacture according to the present invention.
Figure 11:
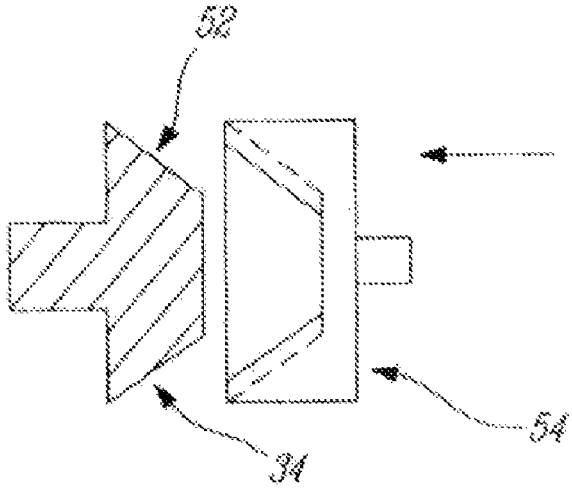
Figure 12:
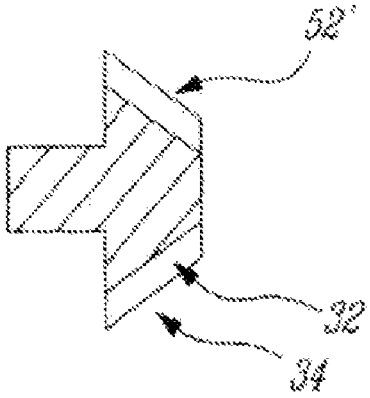

Referring to FIGS. 10-12, in one embodiment, the present invention is injection moulded, using generally typical metal injection moulding techniques, except where the present invention departs from such techniques. The present method will now be described. As represented schematically and cross-sectionally in FIG. 10, such moulding can be done in a mould 50 to provide a body blank 52, and another mould provides a cap blank (neither the cap mould nor cap are shown). Referring to FIG. 11, the body blank 50 is removed from the mould 52 and while still green (i.e. pliable), a form 54 is pressed into the body blank 52, preferably in a purely axial direction (indicated by the large arrow) to form channels 32 in the body 52. The form 54 is then extracted in the reverse direction. The "open" channel geometry described above permits this extraction to be done simply without damaging the shape of the channels in the still-soft body 52. Referring to FIG. 12, the body, now indicated as body 52', is thus left with channels 32 impressed therein. The body 52 may then be heat treated in a conventional fashion to provide the final nozzle 22. Preferably, the "green" body 24 and cap 36 are joined to one another during this sintering operation. The body 24 and cap 36 are moulded separately and placed adjacent to one another before the final sinter operation. In the furnace, the two bodies are joined by sintering, which eliminates an extra step of attaching the two together, for example by brazing or other conventional operations.

Thus, a novel method of manufacturing nozzle tips 22 is also provided. Furthermore, the 'open' channel design described above permits the channel 32 to be moulded using relatively simple mould tooling and operation. As the skilled reader will appreciate, is a "closed" section channel would prevent easy withdrawal or the mould or form from the channels, and thus would require the provision of a much more complex mould, thus increasing manufacturing costs.

The present invention thus permits reproduction of a proven fuel nozzle design (e.g. as generally described in the Applicant's U.S. Pat. No. 6,082,113) in a modular form, which permits the use of much cheaper manufacturing operations, while minimizing the aerodynamic compromises which impact nozzle performance. The multi-piece tip also allows for dissimilar materials for the construction of the part, such as the provision of a harder material to be used on the cap portion to protect against fretting, and thus prolong life—and should wear occur, only the cap need be repaired or replaced. Perhaps more significantly, however, the two-piece design eliminates thermal stresses in the webs of the channels, which stresses often lead to cracking. The configuration, by allowing for flexibility in modes of manufacturing also thereby allows for non-circular channels to be used, which may permit an increase in the flow area of the channel for a given tip geometry. The invention provides an economical yet relatively accurate way to provide the nozzles.

Figure 13:
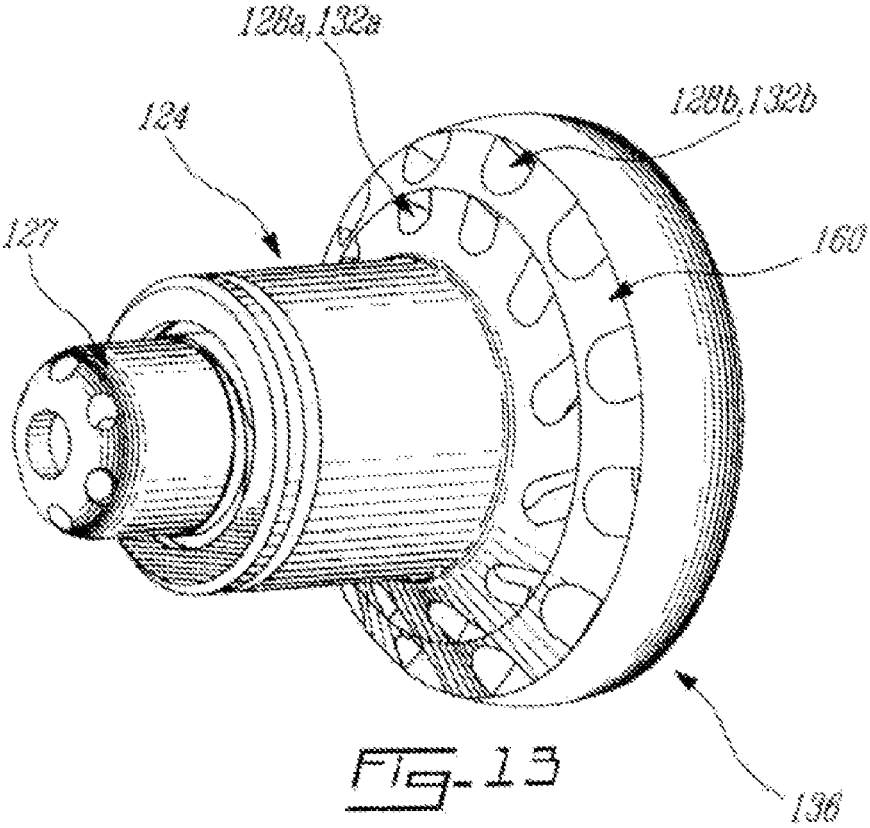
FIG. 13 is a rear isometric view of another embodiment.
Figure 14A:
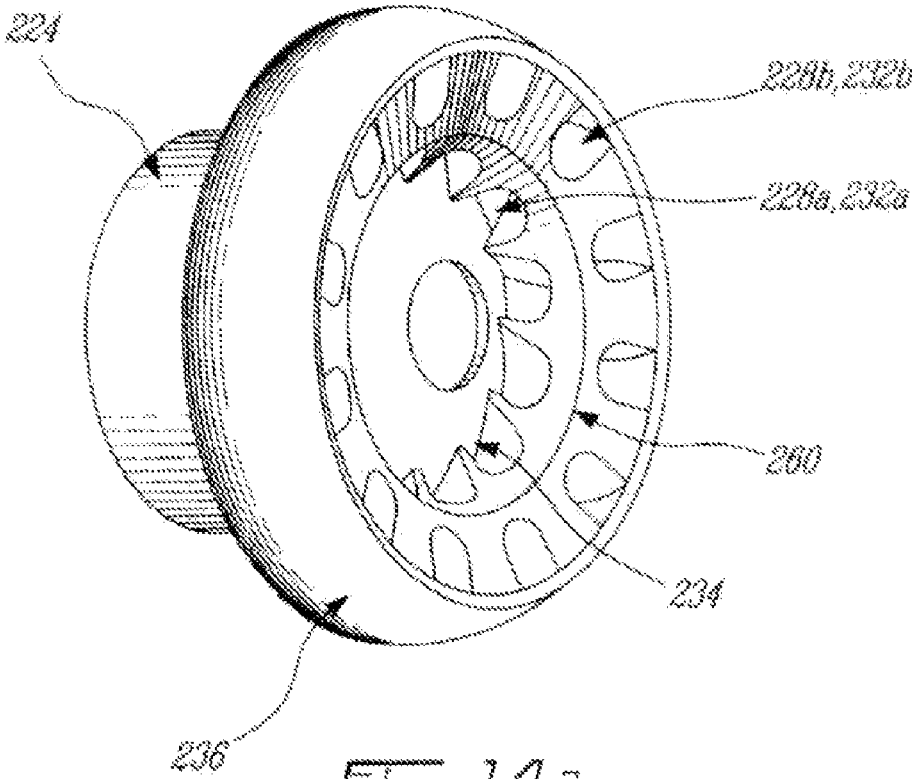
FIG. 14*a* is a front isometric view of yet another embodiment, and FIG. 14*b* an isometric view of a modular component thereof.
Figure 14B:
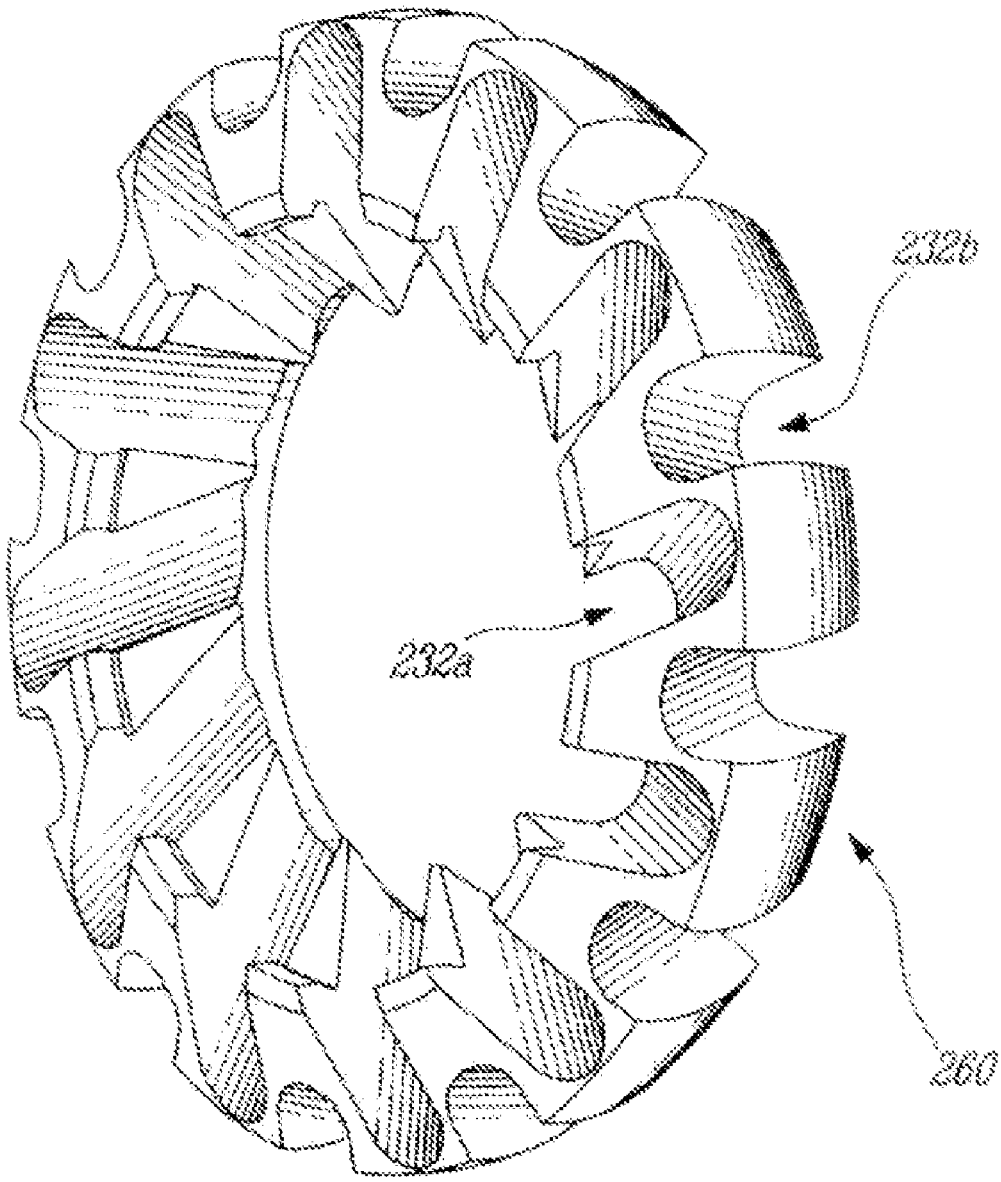

The above description is meant to be exemplary only, and one skilled in the art will recognize that changes may be made to the embodiments described without departing from the invention disclosed. For example, other nozzle styles may employ the present invention, such as simplex or duplex air-assisted nozzles, and the present invention is not limited only to the nozzle types described. For example, referring to FIG. 13, the present invention may be used to provide concentric arrays of air passages 128*a* and 128*b*, respectively provided in body 124 and an annular collar or ring 160 (elements depicted which are analogous to the embodiments described above are indicated with similar references numerals, incremented by 100). Referring to FIGS. 14*a* and 14*b* in another example, dual concentric air passages 228*a* and 228*b* are both provided both in annular ring 260 (one on the inner annular surface of ring 260, and one on the outer annular surface of ring 260), thereby permitting a simpler body 224 and cap 236 to be provided. Simplex and duplex configurations may be provided. The present method is not limited in use to manufacturing fuel nozzles, and other aerodynamic and non-aerodynamic apparatus may be made using these techniques. Still other modifications will be apparent to those skilled in the art, in light of this disclosure, and such modifications are intended to fall within the invention defined in the appended claims.

What is claimed is:

1. A method of making an air blast fuel nozzle for use in a gas turbine engine, the method comprising the steps of:

metal injection moulding a nozzle body in a first mould;

exposing at least a portion of the nozzle body from the first mould;

while the nozzle body is still in a green state, impressing a second mould against at least a portion of the exposed portion of the nozzle body, the second mould leaving an array of open-section air channels in the exposed portion of the nozzle body, the open-section air channels providing aerodynamic airflow surfaces;

sintering the nozzle body;

providing a second body;

covering the open-section air channels with the second body to form air swirl passages, and joining the second body to the nozzle body.

2. The method of claim 1 wherein the step of joining comprises placing the second body adjacent to the nozzle body during sintering and sintering the two bodies together.

3. The method defined in claim 1, wherein the second mould is pressed against the nozzle body in a first axial direction and then withdrawn in a second axial direction opposite to said first axial direction.

4. The method defined in claim 1, wherein the open-section channels are defined in a conical peripheral surface of the nozzle body about a central fuel passage extending axially through the nozzle body.

* * * * *